United States Patent [19]

Strydom

[11] 4,010,762

[45] Mar. 8, 1977

[54] CIGARETTE ROD CONDITION DETERMINING

[75] Inventor: Mauritz Leon Strydom, Stellenbosch, South Africa

[73] Assignee: Tobacco Research and Development Institute Limited, Zug, Switzerland

[22] Filed: May 13, 1976

[21] Appl. No.: 685,957

Related U.S. Application Data

[63] Continuation-in-part of Ser. No. 529,869, Dec. 4, 1974, abandoned.

[30] Foreign Application Priority Data

Dec. 11, 1973 South Africa ..... 73/9394
Aug. 21, 1974 South Africa ..... 74/5369

[52] U.S. Cl. ..... 131/21 B
[51] Int. Cl.[2] ..... A24B 7/14; A24C 5/32
[58] Field of Search ..... 131/21 R, 21 B, 21 D

[56] References Cited

UNITED STATES PATENTS

| | | | |
|---|---|---|---|
| 2,163,415 | 6/1939 | Stephano | 131/21 B |
| 2,523,117 | 9/1950 | Holt et al. | 131/21 B UX |
| 2,667,172 | 1/1954 | Broekhuysen et al. | 131/21 B |

FOREIGN PATENTS OR APPLICATIONS

| | | | |
|---|---|---|---|
| 995,604 | 6/1965 | United Kingdom | 131/21 D |

*Primary Examiner*—Stephen C. Pellegrino
*Attorney, Agent, or Firm*—Ladas, Parry, Von Gehr, Goldsmith & Deschamps

[57] ABSTRACT

The hardness of a cigarette rod is determined while it is being made on a cigarette making machine by measuring the strain imposed on a member in the rod closure region. The member is usually a segment of the tongue piece, but could be a segment of the base. The segment in question is mounted to fixed structure by means of a support arm. A strain gauge is positioned on the support arm and the output of the strain gauge is a measure of the hardness of the rod.

6 Claims, 6 Drawing Figures

10
14
13
9
11
12

18
20
16
19
17
23
22
12
21
15
24
25

CIGARETTE ROD CONDITION DETERMINING

This invention relates to and is a continuation in part of U.S. Ser. No. 529,869, now abandoned. The invention is concerned with the determination of the condition of cigarette rods, including filter rods, during their manufacture.

For determining the hardness or filling power of cigarettes a laboratory hardness testing instrument is normally used. However, such determinations cannot be made on the cigarette making floor and of necessity have to be made some time after the rod section in question has left the cigarette making machine. By the time that there is feedback from the testing instrument, conditions on the floor may have changed so that the feedback is no longer valid.

This problem has been with the cigarette industry for some time and various solutions have been suggested. For example in U.S. Pat. no. 2,667,172 it is proposed to fit strain gauges to those parts of a cigarrett making machine which effect rod closure. The measured changes in strain are then used to detect unsuitable cigarettes. However this process is unreliable for the hardness measured thereby does not correlate satisfactorily with the hardness measured on a laboratory instrument.

It is an object of the present invention to provide a rod making machine which ensures a better correlation coefficient.

The invention is further discussed by way of example with reference to the accompanying drawings, in which FIG. 1 is a perspective view of a making bed of a standard modern cigarette making machine with one part shown in an exploded position;

Figures 1, 2:
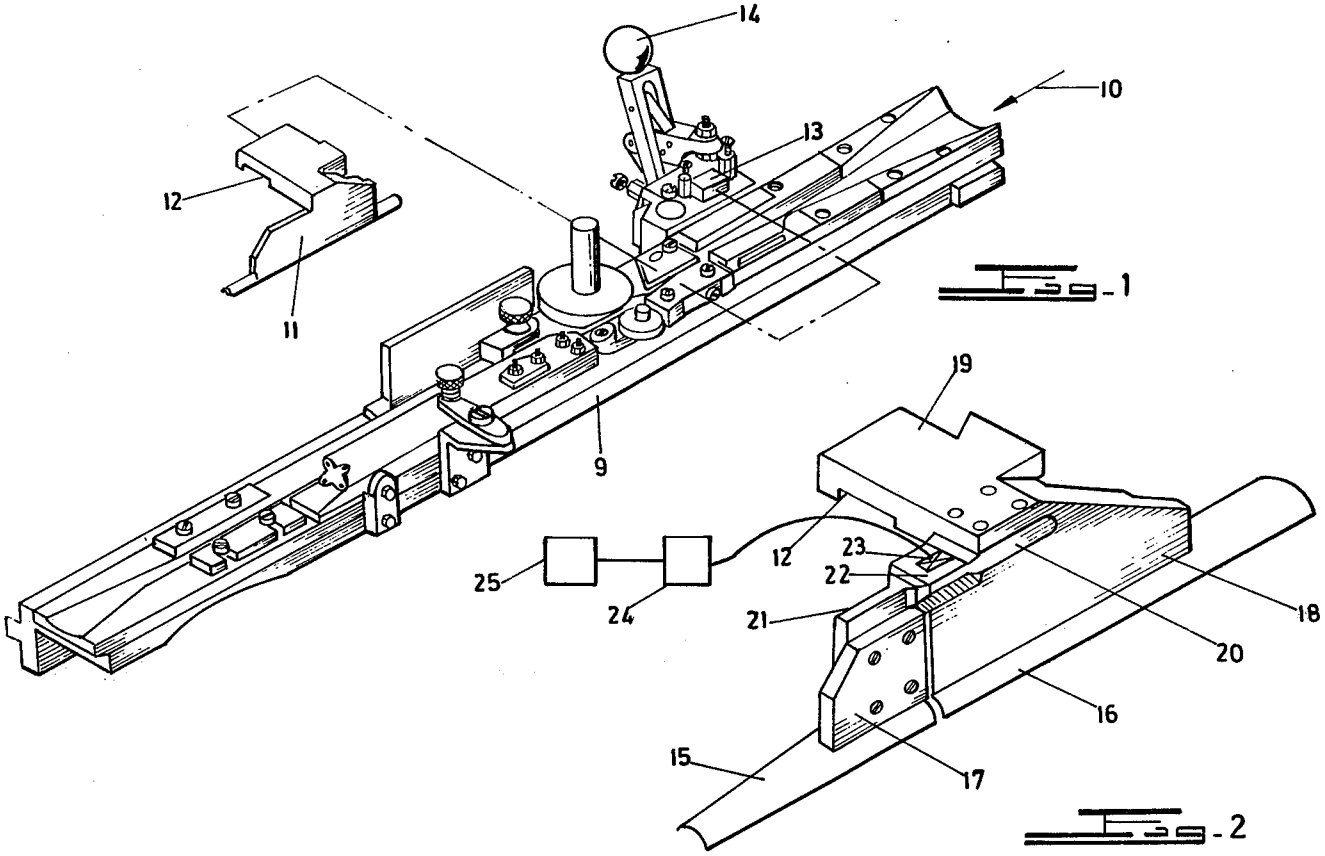
FIG. 2 is a perspective view of a tongue piece of the invention.

FIG. 1 shows the making bed of a modern cigarette making machine that can be found in cigarette factories the world over. Tobacco showered on to a paper tape enters the bed in the direction of arrow 10. The tobacco is rounded and the tape is wrapped around the tobacco rod in a well-known way which needs no further elucidation here.

The final rounding of the rod is performed between a downwardly facing elongated concave part known as the tongue piece and the garniture, i.e. the trough in which the tape runs. In FIG. 1 a tongue piece assembly 11 is shown removed from the machine. An inverted slot 12 on the assembly fits over a block 13 on the machined bed. In use a grip type clamp 14 clamps the tongue piece in place.

Figure 3:
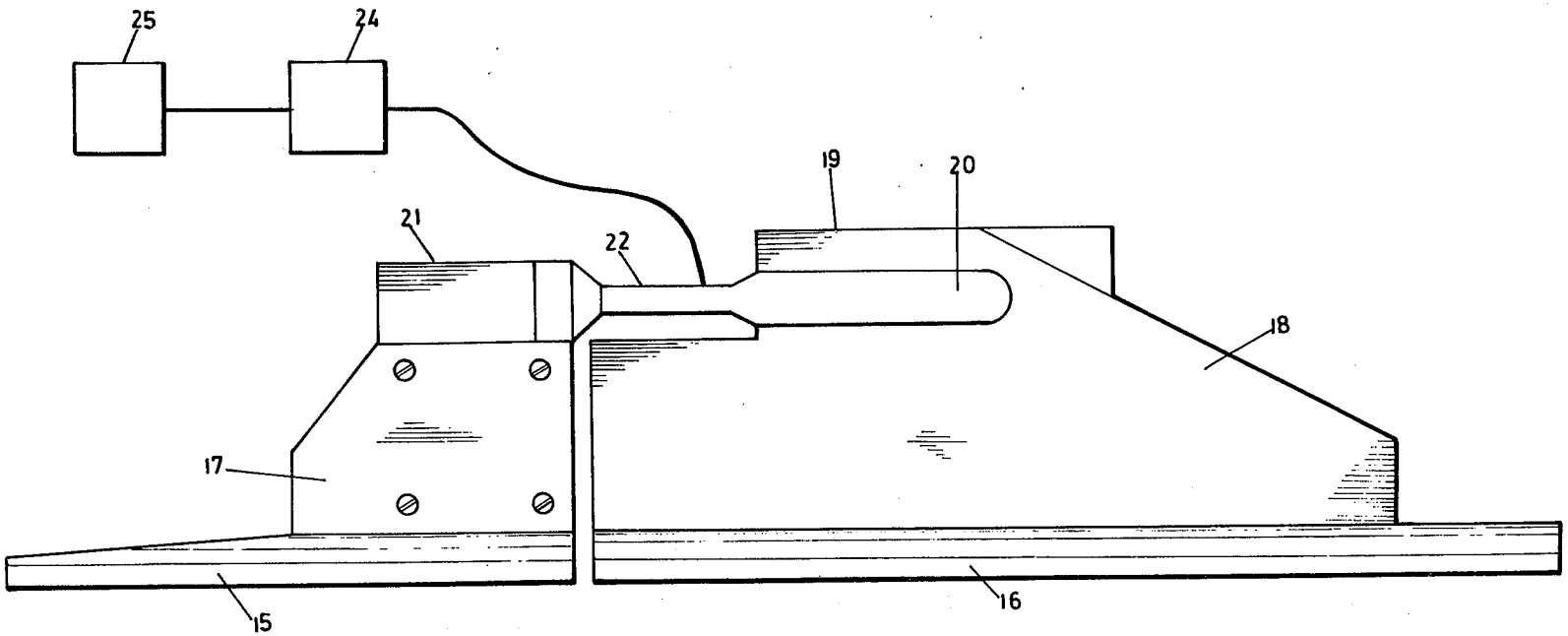
FIG. 3 is an enlarged side view of FIG. 2.

The tongue piece illustrated in FIGS. 2 and 3 is more or less identical to the assembly 11 in FIG. 1. However in this tongue piece the shaping concave is in two parts 15 and 16 formed by cutting the conventional concave in two. Also the supporting flange is split into two parts 17 and 18. The part 18 depends from the conventional attachment flange 19 in the usual way. The flange 19 is formed with a recess in which one arm 20 of a support bracket is firmly anchored. The other arm 21 is turned parallel to the flange part 17 and firmly secured to it by means of screws. Between the arms 20 and 21 there is a saddle 22, which is relatively thin transverse to the direction of the length of the concave.

At the position marked 23 a strain gauge is mounted on the saddle 22.

The output of the strain gauge is amplified if necessary by means of a variable gain amplifier 24 and then recorded on a recorder device such as an oscillograph 25.

Figure 4:
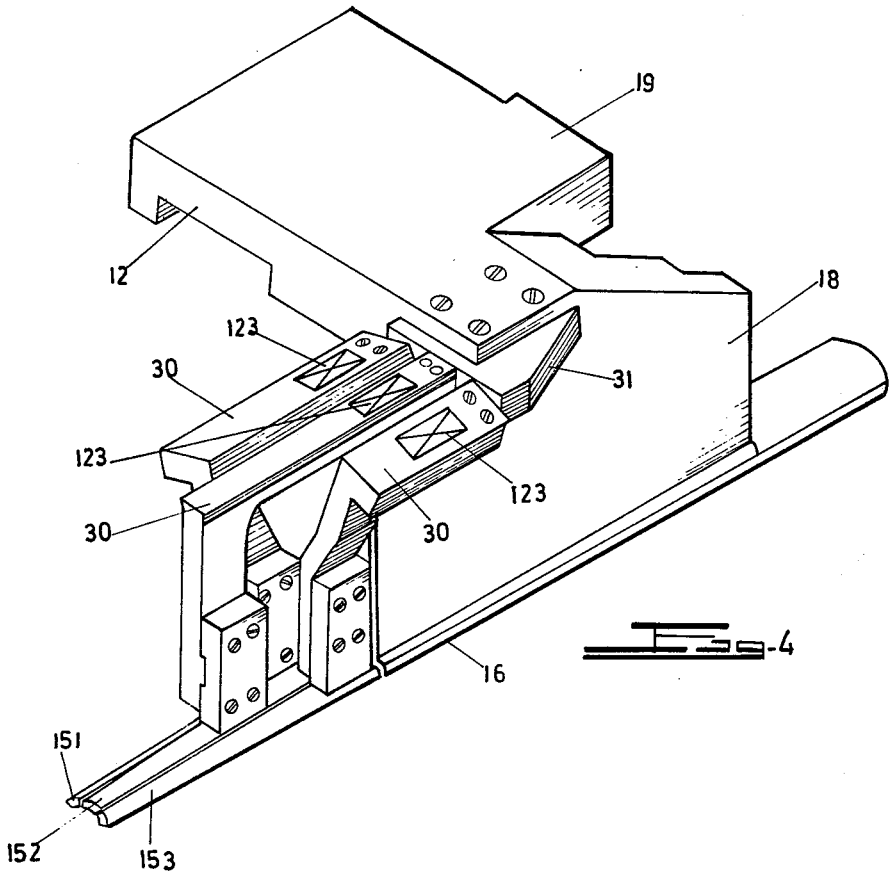
FIG. 4 is a perspective view of a modified tongue piece.

In the embodiment of FIG. 4 the concave has a rear or upstream part 16 and a front or downstream part which is separate from the rear part 16. The front part is split in the longitudinal direction into three parts 151, 152 and 153 which are carried by three support brackets 30. These brackets are anchored on a joint piece 31 entering a recess in the flange 19. Three strain gauges 123 are positioned where indicated in the drawing.

Figure 5:
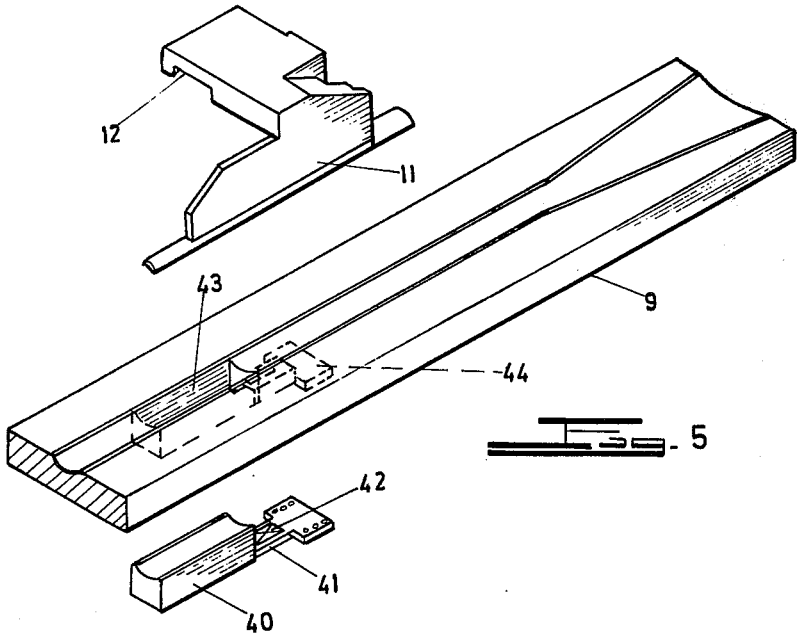
FIG. 5 is an exploded perspective view showing the use of a garniture segment.

FIG. 5 shows a segment 40 of the garniture fitted to a support arm 41 carrying a strain gauge 42. The segment 40 fits into a hole 43 in the floor of the bed 9 and the end of the support arm 42 is screwed into a recess 44. The position of the segment 40 is just under the front end of the concave of the tongue piece 11.

Experiments were set up to test various configurations. The configurations were as follows.

1. Tongue piece No. 1

This was a tongue piece as illustrated in FIGS. 1 and 5 unchanged except that the front end of the concave was machined with a flat on top to take a strain gauge just forwardly of the support flange.

2. Tongue piece No. 2

This is the tongue piece of FIG. 2. The split between front and back was 25 mm from the front.

3. Tongue piece No. 3

This was the tongue piece of FIG. 4 split laterally 25 mm from the front and divided into three longitudinal sections.

4. Garniture

This was the arrangement of FIG. 5.

Figure 6:
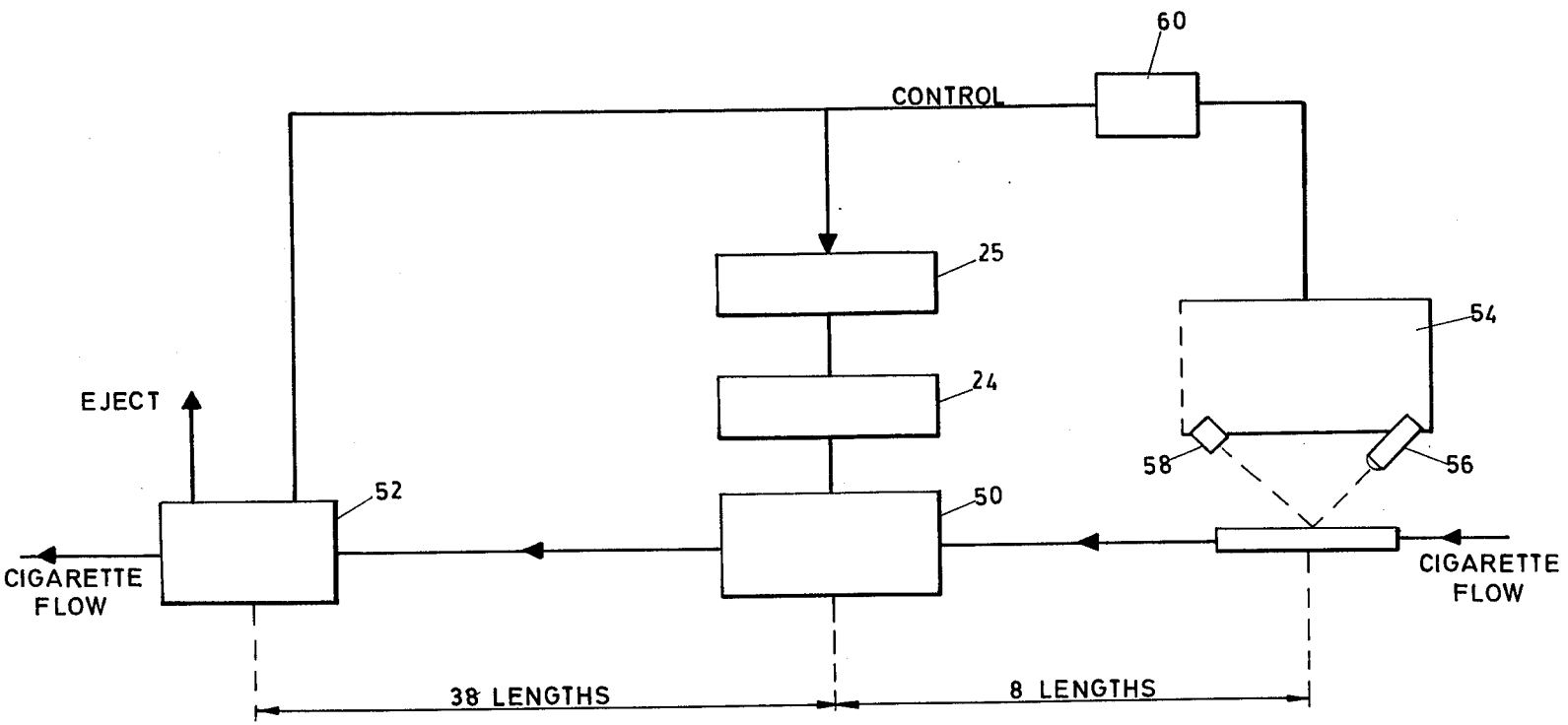
FIG. 6 is a schematic illustration of the arrangement of the apparatus used to test the invention.

Each of the configurations was tested in the manner illustrated in FIG. 6. Use was made of a cigarette making machine 50 fitted with a cigarette ejection system 52. The ejection system is standard equipment on current cigarette making machines and is electrically actuable to eject cigarettes from the cigarette flow. Under normal conditions when the cigarette manufacture is proceeding satisfactorily no cigarettes are ejected and the ejection system is only actuated to enforce quality control procedures.

The cigarette machine 50 was fitted in turn with tongue pieces Nos 1 to 3 mentioned above. The oscillograph recorder 25 was used to monitor selected strain gauge signals, amplified where necessary, by the variable gain amplifier 24. The spacing between the strain gauges on the cigarette rod condition determining device and the ejection system 52 equalled 38 cigarette lengths. An additional 8 cigarette lengths further upstream, i.e. at a point 46 cigarette lengths upstream of the ejection system a photo detector 54 was mounted. The photo detector was a standard device which consisted of a light source 56 and a photocell 58 arranged to intercept light reflected from the light source by an object of suitable reflectivity in the cigarette rod path.

The output of the photocell was amplified by a suitable amplifier 60 and then used to control the operation of the ejection system and the oscillograph recorder 25.

A reel of cigarette paper was specially prepared for the testing procedure by preprinting it with consecutive numbers so that the order in which cigarettes were made could easily be determined. A special reflective marking was also applied to the cigarette paper at a point at least 46 cigarette lengths from its free end.

The control exercised by the photocell 58 and amplifier 60 on the ejecting system was such that the ejection system was actuated to eject all cigarettes made by the machine 50 until the special reflective marking on the cigarette paper was detected by the photocell. The oscillograph recorder 25 was similarly kept inoperative. Upon detection of the reflective marking the oscillograph recorder was actuated to begin recording the output signals of the selected strain gauge and the ejection system was rendered inoperative. The function of the trigger action of the photocell was thus merely to provide a reference point at which the measurement or testing procedure commenced. The cigarettes made subsequently to the trigger action were then collected and arranged in their order of manufacture by means of the numbering system on the cigarette paper, the first strain reading recorded on the oscillograph being the strain reading of the cigarette which was in the cigarette machine 50 at the time the oscillograph 25 commenced recording. In other words, the first 38 cigarettes after ejection ceased were discarded.

Correlation between each cigarette and its strain reading recorded by the oscillograph was established by the use of the known relationship between the oscillograph paper speed and the number of cigarettes made per unit time, each of these quantities being easily measurable.

Thereafter each cigarette was tested in a Riwhard testing machine (US Pat. No. 3,668,928). The two sets of readings were then compared to determine whether the amplitudes of the signals recorded on the oscillograph were related by a fixed constant of proportionality to the Riwhard hardness figures. Correlation coefficients were thus established between the two sets of readings.

These coefficients are given in the following table:

| Configuration | Correlation coefficient Riwhard hardness vs Oscillograph recording | Degrees of freedom |
|---|---|---|
| Tongue piece No. 1 | 0,21 | 100 |
| Tongue piece No. 2 | 0,51 | 100 |
| Tongue piece No. 3 | 0,53 | 100 |
| section No. 151 | 0,53 | 100 |
| section No. 152 | 0,58 | 100 |
| section No. 153 | 0,34 | 100 |
| Garniture No. 1 | 0,39 | 100 |

Statistically for degrees of freedom of 100 a correlation coefficient of 0.254 is already significant for a 99% confidence limit. This means that in all cases except tongue piece No. 1 a 99% confidence exists that there is a significant correlation between the laboratory hardness testing instrument and strain gauge output.

The strain gauge 123 of the centre concave 152 of tongue piece No. 3 gave the best correlation of the three tongue pieces. The outputs from the concaves 151 and 153 were probably affected by an additional movement exerted due to sideways movement. In the practical test situation this could not be prevented.

It is clear then that the present invention has turned the interesting proposal of U.S. Pat. No. 2,667,172 (tongue piece No. 1) into a practical tool which can be utilised for immediate feedback.

The invention lends itself readily to either manual or automatic control of the cigarette making machine to maintain a desired cigarette hardness. The deformation or hardness indication of the strain gauge output is easily calibrated by placing a known weight on a tongue piece and observing the strain gauge output. This reading is then imperically related to an average hardness reading taken of the cigarettes. In practice the strain gauge output is displayed on a meter which then gives a relative indication of the hardness of the cigarettes. The operator is thus able to take corrective action when the meter reading deviates outside preset limits. In an automatic case the strain gauge outputs could be monitored electrically and employed to adjust the tobacco showering rate or some other parameter.

I claim:

1. In a rod making machine comprising means to forward material such as tobacco from which a rod is to be made in the form of a stream along a predetermined path, and a throat along the path in which material is compressed to rod-shape as it is forwarded along the path, the improvement that the throat comprises at least one curved elongated segment free on all sides from the other throat components, a cantilever arm fixed at one end to the machine and at the other end to the segment, a strain gauge mounted on the cantilever arm between the machine and the segment, and means to detect the output of the strain gauge.

2. The machine claimed in claim 1 in which the throat is formed by a garniture and a tongue piece.

3. The machine claimed in claim 2 in which the downstream end of the tongue piece is separated from the upstream end of the tongue piece and the downstream end is mounted to the arm.

4. The machine claimed in claim 2 in which the downstream end of the tongue piece is separated from the upstream end of the tongue piece, the downstream end is split into at least two sections, each section is mounted to a separate arm a strain gauge is placed on each arm and the output of each strain gauge is detected.

5. The machine claimed in claim 2 in which a segment of the garniture is formed as an insert in the garniture and the insert is mounted to the arm.

6. The machine claimed in claim 1 in which the arm is thin parallel to the direction of the prescribed path between the segment and the machine.

* * * * *